United States Patent [19]

Duda

[11] Patent Number: 5,020,294

[45] Date of Patent: Jun. 4, 1991

[54] EXPANSION JOINT FOR COVERED PANELS

[76] Inventor: Robert W. Duda, P.O. Box 649, Blairstown, N.J. 07825

[21] Appl. No.: 519,850

[22] Filed: May 7, 1990

[51] Int. Cl.[5] ..... E04B 1/68; E04F 15/14

[52] U.S. Cl. ..... 52/573; 52/459; 52/470

[58] Field of Search ..... 52/573, 468, 396, 466, 52/464, 460, 459; 16/16, 7; 404/47, 54, 68; 14/16.5

[56] References Cited

U.S. PATENT DOCUMENTS

| | | | |
|---|---|---|---|
| Re. 28,408 | 5/1975 | Nelsson | 52/468 |
| 1,153,152 | 9/1915 | Brucker | 52/468 |
| 1,864,130 | 6/1932 | Gibian | 52/464 |
| 2,116,846 | 5/1938 | Pilcher | 16/7 |
| 2,803,858 | 8/1957 | Rader | 52/364 |
| 3,372,521 | 3/1968 | Thom | 52/395 |
| 3,390,501 | 7/1968 | Driggers | 52/395 |
| 3,408,782 | 11/1968 | Kovacs | 52/220 |
| 3,745,726 | 7/1973 | Thom | 52/98 |
| 4,067,155 | 1/1978 | Ruff | 52/466 |
| 4,071,994 | 2/1978 | Ammann | 52/573 |
| 4,111,582 | 9/1978 | Tippett | 404/47 |
| 4,774,795 | 10/1988 | Braun | 52/396 |
| 4,784,516 | 11/1988 | Cox | 404/69 |
| 4,833,851 | 5/1989 | Ohmatsu | 52/396 |

OTHER PUBLICATIONS

Promotional Catalog-Metalines Trench Covers & Gratings Catalog #TC-5.

Promotional Catalog-Metalines Expansion & Seismic Joint Covers, Catalog #30.

Promotional Catalog-Erie Metal Specialties-Applied Technology for the Expansion Joint Industry.

Data Sheet-Erie Metal Specialties-Polycrete/Membrane Expansion Joint System.

*Primary Examiner*—John E. Murtagh

*Attorney, Agent, or Firm*—Eckert Seamans Cherin & Mellott

[57] ABSTRACT

An expansion joint for floor panels such as concrete slabs, as well as wall and ceiling panels, has a thickness equal to a covering material on the panels and is surface mounted. An expansion joint member which can be an integral extruded or otherwise formed length bridges across substantially abutting panels at a variable gap, the panels having coplanar surfaces on at least one side and a covering material thereon. The joint member has a U-shaped body portion having a width greater than a maximum width of the gap, and fasteners adjacent one side of the gap for affixing the body portion to one of said panels defining an attachment side of the joint. The body portion bridges across the gap and rests freely on the coplanar surface of the panel on an opposite side of the gap. Wing members are attached to the body portion on the attachment side and on the opposite side, in each case at a space from the lower surface of the body portion equal to a thickness of the covering material on said attachment side.

17 Claims, 2 Drawing Sheets

Fig. 1.
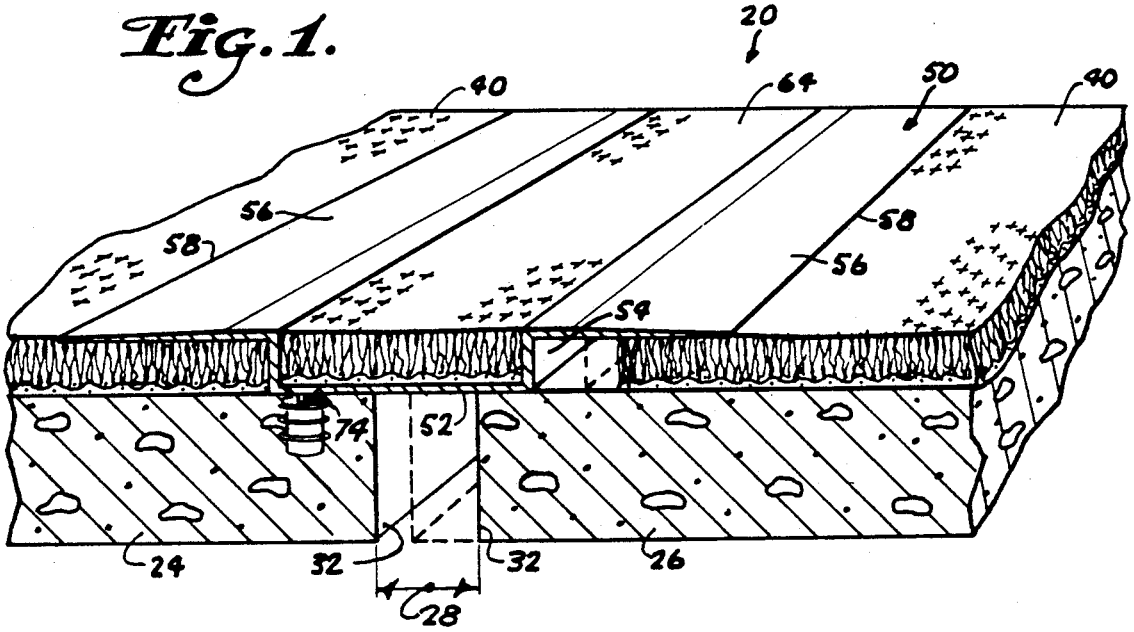
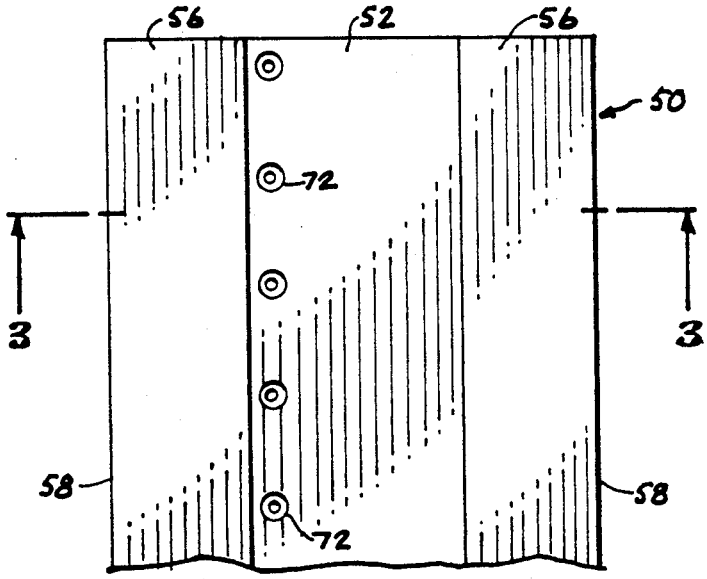
Fig. 2.
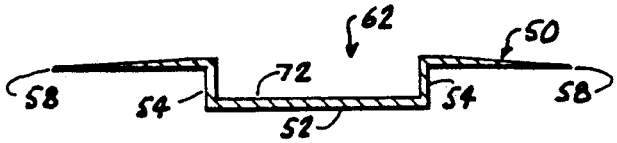
Fig. 3.

Fig. 4.
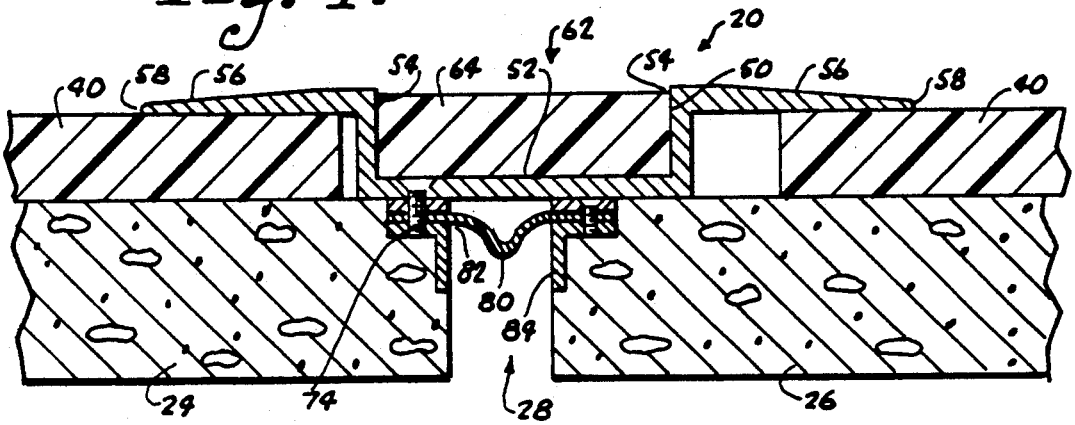
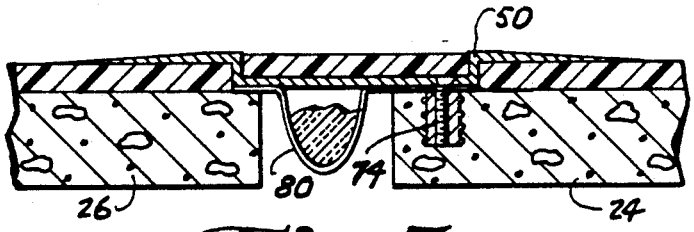
Fig. 7.
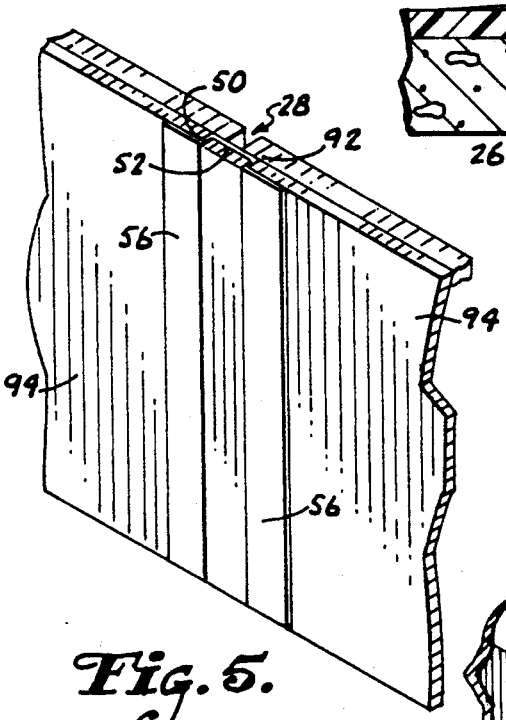
Fig. 5.
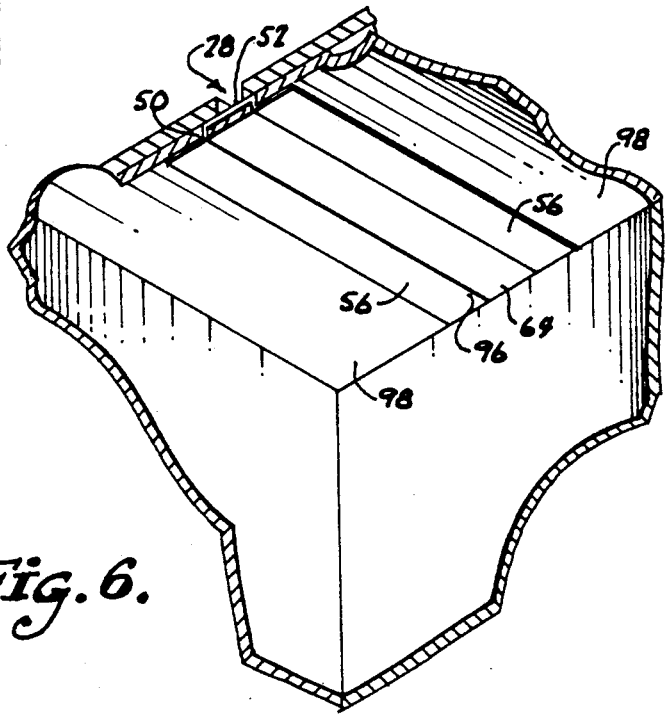
Fig. 6.

EXPANSION JOINT FOR COVERED PANELS

BACKGROUND OF THE INVENTION

1. Field of the Invention

This invention relates to the field of expansion joints for abutting slabs or panels wherein the joint is to be covered by a facing or covering material. In particular, the invention concerns an expansion joint between abutting decks in a building, to be covered with a facing material such as carpeting, tile or other coverings arranged to bear traffic. The invention also relates to expansion joints in walls, ceilings, etc., wherein a facing material is to be placed smoothly over a varying gap between abutting panels.

2. Prior Art

An expansion joint in a floor, wall, ceiling or other structure joins two members defining substantially coplanar surfaces on at least one side, the two members generally abutting along a line but defining a gap between them that varies in width over time. The width of the gap can change as a function of temperature and load variations on the means supporting the two members. To avoid cracking and similar structural failure of the two members or the means supporting them, the expansion joint allows the joint to vary in a flexible manner.

Known expansion joints have a number of objectives relating to maintaining a connection between the two relatively movable members notwithstanding the gap, and/or maintaining a smooth surface over the gap, for example for bearing traffic, and sealing between the two members. It is usually desirable that the joint not define a discontinuity in the surface defined by the abutting slabs, panels or the like. In a floor expansion joint for example, a discontinuity on an upper surface is a tripping hazard. Where a joint on a floor, wall, ceiling or the like is to be covered for example by carpeting, wall coverings, etc., a discontinuity may form in the covering material. This problem is not resolved even if the expansion joint itself maintains a smooth upper surface for the joined members The discontinuity of course varies with the gap between the abutting members.

If one attempts to merely cover over an expansion joint, problems arise from the need to maintain an even upper surface and thereby avoid a tripping hazard. For example, it is possible to attach a flat strip of metal or other stock to cover the gap in an expansion joint. The strip is attached to one of the panels and allowed to extend across the gap to lap over the other panel by an amount greater than a span of variation in the width of the gap. To avoid raised edges, settable floor compound can be applied adjacent the strip and feathered (made progressively thinner) proceeding away from the strip to form a very gradual hump up to the level of the thickness of the strip. Such feathered floor compound is effective to avoid a tripping hazard on the side of the joint where the strip is attached to one of the panels. On the other side, however, expansion causes a gap to open between the extreme edge of the strip and the edge of the flooring compound. Contraction of the joint exerts a pressure between the strip and the flooring compound tending to break away the flooring compound or causing the strip to bow upwardly. In any of these cases, this technique is not effective to obtain a smooth upper surface without a tripping hazard in at least some of the conditions of the expansion and/or contraction of the gap.

The abutting members of an expansion joint are generally relatively movable laterally toward and away from the gap, but also may be movable longitudinally along the gap. Both forms of relative movement present the possibility of a bulge, ripple or similar discontinuity in any covering material. Assuming that it is possible to provide an expansion joint with variable length connecting structures that maintain a smooth upper surface, such structures still do not solve problems associated with covering layers, particularly of flexible material, applied over the gap. A carpet applied over a gap, for example, will bulge when the gap closes and will stretch or pull away from its moorings when the gap opens, even if the expansion joint applied to the floor is fully effective to maintain a smooth upper surface of the joined members. There is a need to resolve the problems associated with expansion joints where the joint is to be covered.

In known expansion joint structures, connection flanges forming the opposite sides of the joint across the gap are rigidly fixed to the edges of the two members to be joined across the gap, and flexible or length-variable elements of the joint bridge across these rigidly-fixed flanges. The flanges are arranged flush with the surfaces of the two members, typically on the upper surface and also on the surface facing the gap. This requires that a space be formed in the two members for receiving the joint flanges such that the joint flanges are flush with the top surface and the end faces of the joined members. U.S. Pat. No. 3,372,521—Thom discloses a floor joint cover assembly wherein bolts are embedded in both members of a floor joint formed of cast slabs, and the upper edges of the members at the end faces adjacent the joint are contoured to a shape complementary with the joint flanges. The structure must be installed when the slabs are not yet hardened, such that the bolts can be embedded and the complementary shape formed. It is possible in a joint of this type to mill out the area of the slabs to be occupied by the joint flanges after the slabs are set, or to devise molding frames of a shape complementary with the joint flanges, such that the necessary shape is obtained when poured slabs set. However, both these alternatives are complex and expensive. Moreover, the resulting joints do not resolve the problems of flexible coverings such as carpets.

U.S. Pat. No. 3,390,501—Driggers (see FIG. 2) discloses a joint having a structure that protrudes upwardly from the joint in the area of the gap, by an amount equal to the height of finish materials such as plasterboard, which finish material abuts the protruding portions of the joint at both sides. This is an alternative to a joint similar to that of Thom, wherein anchoring structures must be embedded in a wet or green slab. The joint may be useful where the facing material (e.g., plasterboard) on the slab on either side of the joint is rigidly connected to the slab, and in view of the rigid structures of the slab and facing material, the composite structure is similar to that of Thom in that the joint resides flush in a complementary contour formed at the facing edges of the two rigid composite joined members. Notwithstanding these aspects, the Driggers joint defines a surface discontinuity and a resulting tripping hazard if the joint is used for floors.

One method of minimizing problems with gapping at an expansion joint is to provide a cover panel that floats between the end faces of the joined members, and means for centering the floating cover panel. An example is disclosed in U.S. Pat. No. 3,745,726—Thom. This means for dealing with the gap effectively reduces the extent of gap by splitting the gap in half, i.e., producing a smaller gap at each side of the floating panel rather than one full width gap. Nevertheless, gap problems remain.

Other joint structures having joint flanges embedded in the material of the slabs or the like are shown in U.S. Pat. Nos. 4,774,795—Braun; 4,784,516—Cox; and, 4,833,851—Ohmatsu. In general, the joints have flanges rigidly attached to the joined slab members, which flanges define a nip area between them over at least a portion of their extension, that encloses a flexible material. If the gap opens or closes, either a bulge will be raised in the flexible material or a gap will open at an edge. Therefore, these joints lack a continuous smooth coverage across the surface of the joint. If the joints are covered by a finish material (rather than simply provided with a finish material reaching just to the respective edges), the finish material will bulge or stretch even if the joint remains smooth.

U.S. Pat. No. 4,111,582—Tippett discloses a flexible material in a nip that is covered over by a continuous covering layer. Assuming that the flexible material is precisely dimensioned and has the necessary range of expansion without bulging, the joint does not arrange for expansion and contraction movements in the covering material. Instead, the slab members are arranged to move relative to the covering material and the covering material is fixed in place by undisclosed means.

There has been a need to simplify expansion joints while ensuring that the joint maintains a smooth upper surface. The complex expansion joints of the foregoing patents are quite expensive in terms of materials. As a result of the need for embedding the joint flanges in the edges of the joined members, such expansion joints are even more expensive to install. The present invention employs a joint member that is an integral body and attaches to only one of the two joined members. The joint member is easily and inexpensively surface mounted. The joint member overlaps the surface covering material by a fixed amount on the attached-side slab or the like, and overlaps by a variable amount on the opposite side, thereby accommodating expansion and contraction. In the central area of the joint member bridging across the joined members, the joint member is also provided with a strip of facing material, tending to better conceal the joint by providing a relatively uninterrupted extension of facing material across the joint. The joint is effective, and accommodates flexible facing material, at a fraction of the cost of other expansion joints in either materials or installation.

SUMMARY OF THE INVENTION

It is an object of the invention to provide an expansion joint for covered members defining a variable gap, which joint is no higher that the covering on the members and is defined by a joint element that is itself integral and rigid.

It is also an object of the invention to provide an expansion joint which is inexpensive to produce and to install.

It is another object of the invention to provide a traffic-bearing joint that accommodates expansion and contraction of a gap between rigid underlying members as well as relative movement of a covering material, particularly a flexible covering material such as a carpet.

It is another object to improve the appearance of expansion joints to be used with a surface covered with facing material generally.

These and other objects are accomplished by an expansion joint for floor panels such as concrete slabs, as well as wall and ceiling panels, having a thickness equal to a covering material on the panels and which is surface mounted. An expansion joint member which can be an integral extruded length bridges across substantially abutting panels at a variable gap, the panels having coplanar surfaces on at least one side and a covering material thereon. The joint member has a U-shaped body portion having a width greater than a maximum width of the gap, and means receiving fasteners adjacent one side of the gap for affixing the body portion to a top surface of one of said panels defining an attachment side of the joint. The panels need not be contoured or rabbeted to obtain a flush fitting for the joint member. The body portion bridges across the gap and rests freely on the coplanar surface of the panel on an opposite side of the gap. Wing members are attached to the body portion on the attachment side and on the opposite side, in each case at a space from the lower surface of the body portion equal to a thickness of the covering material on said attachment side.

The expansion joint can also include a sealing element for stopping air flow through the gap, the sealing element being a flexible sheet or the like attached to the panels on both sides of the gap. On the attachment side the sealing element can be captured between the joint member and the attachment side panel.

The invention is usefully employed with floor, wall or ceiling expansion joints, but is especially applicable to floor joints intended to bear foot or wheeled traffic. The wings extend along the adjacent surfaces of a floor covering such as a carpet, tile, linoleum or comparable synthetic material, and the joint member has a central channel wherein a strip of the floor covering can be affixed to cover fasteners passing through the joint member and also to improve the appearance of the joint by virtue of the interspersed strip of facing material.

BRIEF DESCRIPTION OF THE DRAWINGS

There are shown in the drawings the embodiments of the invention as presently preferred. It should be understood, however, that the invention is not limited to the precise arrangements and instrumentalities depicted as exemplary embodiments, and is capable of embodiment in other forms and groupings of sub-elements. In the drawings, FIG. 1 is a perspective view, partly in section, showing an expansion joint according to the invention as applied to a floor joint;

FIG. 2 is a plan view of the joint member of the invention;

FIG. 3 is an section view of the joint member of FIG. 2, taken along lines 3—3 in FIG. 2;

FIG. 4 is a section view illustrating an alternative embodiment including a vapor seal;

FIG. 5 is a perspective view illustrating a wall expansion joint;

FIG. 6 is a perspective view illustrating a ceiling expansion joint; and,

FIG. 7 is a section view illustrating an alternative embodiment including a different form of vapor seal.

DETAILED DESCRIPTION OF THE PREFERRED EMBODIMENTS

The expansion joint 20 of the invention, as applied to a floor expansion joint, is shown in FIG. 1 along a section perpendicular to the longitudinal extension of the joint. FIGS. 5 and 6 represent comparable joints applied to a wall and a ceiling, respectively. As shown in FIG. 1, the joint is formed between two panels 24, 26, which in connection with a floor joint may typically be concrete slabs. The joint is also fully applicable to other materials for the joined members. The panels or slabs 24, 26 are supported in the building or the like by structural elements which are not shown. For reasons well known in the building arts, relative movement of the slabs occurs due to diverse influences on their supporting elements, requiring that a clearance or gap 28 be provided between the abutting or nearly abutting end faces 32 of the slabs 24, 26. As the building moves and with periodic expansion and contraction due to thermal influences, forces are applied causing the gap 28 to open and/or close. The gap should be wide enough that at the maximum relative displacement of the panels toward one another, the end faces of the panels barely come into contact. If the gap was not provided, the forces would tend to cause cracking of the floor or the structural members supporting it.

The expansion joint for a floor frequently falls in a traffic area. Whereas it would be possible to simply bridge the gap with a flange-like strip, it would then be necessary to either cut out a rabbet in each of the floor panels to accommodate the strip or smoothly to raise the level of the floor adjacent the strip by means of a flooring compound or the like, in order to prevent a discontinuity in floor height that would become a tripping hazard. Unfortunately, a gap would still open and close between the strip and the edge of the rabbet. If no gap was provided, the strip would bulge or would break away portions of the floor panel at its edge.

The invention provides a joint that bridges over the gap between adjacent floor panels, and employs a variable overlap of the covering material over the floor panels to accommodate expansion. An elongated expansion joint member 50 bridges across the coextensive panels 24, 26 which abut or nearly abut at the variable gap 28. The joint member is disposed directly on the upper coplanar surfaces of the panels 24, 26, at the same level as the covering material 40 thereon. The joint member is attached to one of the panels 24, and slides freely on the upper surface of the other of the panels 26. The lateral wings 56 on the sides of the joint member extend over and overlap the covering material 40. On the attachment side panel 24, there is no relative movement required between the covering and the joint member (although relative movement is possible). On the opposite side panel 26, the body portion 52 of the joint member 50 slides relative to the panel 26 on that side, and the wing 56 similarly slides over the upper surface of the covering. The result is a flat joint that accommodates expansion without bulging, breakage or other problems of flush joints, and also accommodates a covering material, likewise in a manner that does not cause the covering material to gap or to bulge.

The joint member 50 has a body portion 52 of a width greater than a maximum width of the gap 28. Adjacent one end face 32 of the panels, namely at the end face of panel 24 on an attachment side of the joint, the body portion 52 of the joint member 50 can be rigidly affixed to the respective panel 24. In particular, the underside of the body portion 52 is disposed against and fixed to the upper surface of panel 24 at a level coplanar with the upper surface of the panel 26 on the opposite side. Joint member 50, and more particularly body portion 52 thereof, bridges across the gap 28 and rests freely on the upper surface of panel 26 on the opposite side of the gap. With expansion and contraction, joint member 50 remains stationary relative to panel 24, and slides over panel 26 as well as the covering 40 on panel 26.

A first wing member 56 is attached to the body portion 52 of joint member 50 on the attachment side of the joint, at a space above the lower surface of the body portion 52. This space is substantially equal to the thickness of the covering material 40 on the attachment side, and accordingly the wing 56 is disposed along the surface of the covering 40, which the wing overlaps for at least a short distance. A second wing member 56 is attached to the body portion 52 of joint member 50 on the opposite side, namely over panel 26. This second wing member is also attached to the body portion 52 at a space above its lower surface substantially equal to the thickness of the covering material 40 on the opposite side. With expansion and contraction of the joint, the second wing 56 slides back and forth on the upper surface of the covering material 40. Covering material 40 is spaced back from the body portion 52 or joint member 50 by an amount equal to or greater than the maximum displacement of the gap 28. Therefore, when the gap 28 is at its minimum, the edge of the covering material 40 does not abut the body portion 52, and never is caused to bulge.

The body portion 52 and the first and second wings 56, 56 are preferably integral portions of the expansion joint member 50, which can be extruded or otherwise formed in a sheet-like configuration. The joint member can be formed of folded or bent sheet material, particularly where the joint is not intended to experience traffic, for example in a wall or ceiling joint.

The body portion 52 is U-shaped in cross-section, defining an internal channel 62. Inasmuch as the material of the joint member is relatively thin, the channel 62 is of appropriate depth for receipt of a strip 64, preferably of the same covering material 40 which covers panels 24, 26. The strip can be adhesively affixed in place, covering the fasteners which affix the body portion 52 to the attachment-side panel. The strip interrupts the visual appearance of the joint member, which is preferably extruded metal, plastic or the like, tending to visually conceal the expansion joint.

The first and second wings 56 preferably are tapered in thickness toward edges thereof remote from the body portion. The wings can be at least slightly resilient, and can be slightly inclined downwardly, tending to form a ramp-like transition to the highest point of the joint member at the the edges of the U-shaped body portion. Preferably, the compression of the covering material 40 under the wings 5 is minimal, whereby the covering material is relatively free to slide relative to the wings 56 as the joint expands or contracts. In the preferred embodiment, the wings are tapered and their undersides remain disposed parallel to the upper surface of the panels 24, 26.

The wings can be provided with anti-slip roughened upper surfaces (e.g., ribs). The wings can also be provided with decorative aspects such as surface designs, scalloped edges and the like. It is preferred, however, that the undersides and edges of the wings be smooth, to avoid binding the covering material in a manner that would prevent free relative sliding of the covering material relative to the wings.

The body portion 52 of the joint member 50 is affixed to the panel 24 on the attachment side of the gap by fasteners disposed adjacent an edge of the body portion. The fasteners, for example countersunk screws, can be placed at the extreme edge of the bottom of U-shaped body portion 52, such that the fasteners in use are spaced back from the extreme edge of panel 24 and are less likely to cause chipping or breakage of panel 24. In an embodiment for a carpet covered expansion joint for concrete panels, for example, the bottom of the body portion 52 can be four inches wide and ⅛ inch thick extruded aluminum, with the centerlines of countersunk holes 72 for the fasteners 74 about ¼ to ⅜ inch from the vertical wall of the U-shaped portion. The wings in this embodiment can be, for example, two to four inches in width, with the taper of the wings commencing at a space (e.g., one inch) from the vertical wall and proceeding to a minimum thickness of 3/32 inch at the outer edge of each wing, where the extreme edge is rounded. Other dimensions are of course possible. It is also possible to attach the body portion to the panel using structural adhesive rather than a screw or similar discrete fastener.

The invention is likewise applicable to a wall joint 92 as shown in FIG. 5, with a covering material 94 such as panelling, gypsum board (and/or filling compound), flexible sheet covering or the like; as well as to a ceiling joint 96 with a covering material 98 as shown in FIG. 6. The dimensions of the joint member are varied according to the gap dimensions and to the situation, with relatively narrower wings being apt for more decorative and non-traffic-bearing applications.

The expansion joint of the invention comprises two coextensive panels 24, 26 substantially abutting at a variable gap 28, the panels 24, 26 having coplanar surfaces on at least one side. A covering material 40 is disposed on the panels 24, 26, the covering material 40 extending on each side of the gap 28 to a point spaced back from the gap. A joint member 50 with a body portion 52 has a width greater than a maximum width of the gap 28, and means 72 adjacent one side of the gap for affixing the body portion 52 to one of said panels 24 defining an attachment side of the joint, the body portion 50 being affixed against the coplanar surface of the panel 24 on said attachment side, the body portion 50 bridging across the gap 28 and resting freely on the coplanar surface of the panel 26 on an opposite side of the gap 28. A first wing member 56 is attached to the body portion 52 on the attachment side 24 at a space from said lower surface of the body portion 52 substantially equal to a thickness of the covering material 40 on said attachment side 24, and a second wing member 56 is attached to the body portion 52 at a space from said lower surface of the body portion 52 substantially equal to a thickness of the covering material 40 on said opposite side 26, said first and second wing members 56 extending over the covering material 40 on both sides of the gap 28.

The body portion 52 is affixed to the panel 24 on the attachment side of the gap 28 by fasteners 74 disposed adjacent an edge of the body portion 52. The body portion 52 of the expansion joint member 50 preferably is formed of sheet material, the body portion 52 being U-shaped in cross-section. A length 64 of the covering material 40 is disposed in the U-shaped cross-section 62 of the body member 52 such that said wings 56 and said length 64 of covering material 40 define a continuous surface substantially at a height of the covering material 40. The body portion 52, first wing 56 and second wing 56 can be integral portions of the expansion joint member 50. The first and second wings 56 are preferably tapered in thickness toward edges thereof remote from the body portion 52.

The joint member of the invention is useful alone as well as in addition to other forms of expansion joints. In FIG. 4, the seal of the invention is used together with a vapor seal type expansion joint which is attached to the top or facing ends of the panels 24, 26. Seal strip 80 and/or the mounting flanges 82, 84 therefor are disposed at least partly between the body portion 52 and the panels 24, 26 for sealing air passage through the gap 28. As shown in FIG. 4, the seal strip 80 is affixed to the panels 24, 26 on both sides of the gap 28. On the attachment side 24, the vapor seal can be fastened by the same screw 74 that attaches the joint member of the invention, while on the opposite side the vapor seal 80 is attached separately such that joint member 50 and panel 26 remain relatively movable. A similar configuration can be employed with other forms of expansion joints.

Preferably, the fasteners 74 are countersunk screws. The expansion joint member 50 can be a length of extruded material of a material chosen from the group consisting of plastic, metal and wood. The preferred material is extruded aluminum, however, brass and similar decorative metals and like materials are also possible. The panels 24, 26 can be floor panels and the covering material can be a flexible sheet material, such as carpet. The panels 24, 26 can also be wall panels or ceiling panels.

FIG. 7 illustrates an alternative embodiment wherein a vapor seal is affixed to the top surfaces of the two panels. The expansion joint member 50 is placed directly over the vapor seal material, and attached to one of the two panels. The vapor seal includes a non-flammable strip 80, for example of sheet metal. Thermal insulation can be placed in the depression defined by the strip, which defines a width sufficient to accommodate expansion of the gap between the panels. On its underside, the strip is adhesively affixed to panel 26, and optionally can be adhesively affixed to panel 24 on the attachment side in the same manner. On the attachment side panel 24, the joint member as well as the vapor seal strip are affixed by fastener 74, which in this embodiment is a screw received in an expansion sleeve or the like, disposed in a bore in panel 24. The joint member 50 slides freely on the upper surface of the vapor seal 80 on the free side panel 26, whereby the joint member allows for expansion and contraction of the gap while maintaining a continuous upper surface for traffic. The embodiment of FIG. 7 comprises a vapor seal and expansion joint, but does not require that the vapor seal be inset into the edges of the panels 24, 26, because the minimal thickness of the vapor seal strip allows the joint member 59 to simply rest over the edges of the strip.

The invention having been disclosed, a number of alternatives and variations will now become apparent to persons skilled in the art. Reference should be made to the appended claims rather than the foregoing specification as defining the scope of the invention in which exclusive rights are claimed.

I claim:

1. An expansion joint, comprising:

two coextensive panels substantially abutting at a variable gap, the panels having coplanar surfaces on at least one side;

a covering material on the panels, the covering material extending on each side of the gap to a point spaced back from the gap;

a joint member with a body portion of a width greater than a maximum width of the gap, and means adjacent one side of the gap for affixing the body portion to one of said panels defining an attachment side of the joint, the body portion being affixed against the coplanar surface of the panel on said attachment side, the body portion bridging across the gap and resting freely on the coplanar surface of the panel on an opposite side of the gap, a first wing member being attached to the body portion on the attachment side at a space from said lower surface of the body portion substantially equal to a thickness of the covering material on said attachment side, and a second wing member being attached to the body portion at a space from said lower surface of the body portion substantially equal to a thickness of the covering material on said opposite side, said first and second wing members extending over the covering material on both sides of the gap.

2. The expansion joint according to claim 1, wherein the body portion is affixed to the panel on the attachment side of the gap by fasteners disposed adjacent an edge of the body portion.

3. The expansion joint according to claim 2, wherein the body portion expansion joint member is formed of sheet material, the body portion being U-shaped in cross-section.

4. The expansion joint according to claim 3, further comprising a length of the covering material disposed in the U-shaped cross-section of the body member such that said wings and said length of covering material define a continuous surface substantially at a height of the covering material.

5. The expansion joint according to claim 4, wherein the body portion, first wing and second wing are integral portions of the expansion joint member.

6. The expansion joint according to claim 5, wherein the first and second wings are tapered in thickness toward edges thereof remote from the body portion.

7. The expansion joint according to claim 1, further comprising a seal strip disposed between the body portion and the panels and sealing air passage through the gap, the seal strip being affixed to the panels on both sides of the gap.

8. The expansion joint according to claim 2, wherein the fasteners are countersunk screws.

9. The expansion joint according to claim 5, wherein the expansion joint member is a length of extruded material of a material chosen from the group consisting of plastic, metal and wood.

10. The expansion joint according to claim 9, wherein the expansion joint member is extruded aluminum.

11. The expansion joint according to claim 1, wherein the panels are floor panels and the covering material is a flexible sheet material.

12. The expansion joint according to claim 11, wherein the covering material is carpet.

13. The expansion joint according to claim 1, wherein the panels are wall panels.

14. The expansion joint according to claim 1, wherein the panels are ceiling panels.

15. The expansion joint according to claim 1, wherein the body portion is affixed to the panel on the attachment side of the gap by structural adhesive.

16. The expansion joint according to claim 5, wherein the expansion joint member is a folded blank.

17. The expansion joint according to claim 1, wherein the covering material is rigid.

* * * * *